United States Patent [19]

Yoshinaga

[11] Patent Number: 4,643,671

[45] **Date of Patent: * Feb. 17, 1987**

[54] BURNER DEVICE

[75] Inventor: Sadao Yoshinaga, Ichikawa, Japan

[73] Assignee: Prince Industrial Development Co., Ltd., Tokyo, Japan

[ * ] Notice: The portion of the term of this patent subsequent to Jul. 1, 2003 has been disclaimed.

[21] Appl. No.: 833,919

[22] Filed: Feb. 26, 1986

Related U.S. Application Data

[62] Division of Ser. No. 751,373, Jul. 2, 1985, Pat. No. 4,597,732.

[30] Foreign Application Priority Data

Jul. 7, 1984 [JP] Japan ..... 59-102553

[51] Int. Cl.[4] ..... F23Q 7/12

[52] U.S. Cl. ..... 431/255; 431/344

[58] Field of Search ..... 431/255

[56] References Cited

U.S. PATENT DOCUMENTS 4,526,532 7/1985 Nelson ..... 431/255

4,538,984 9/1985 Nakagawa ..... 431/255

*Primary Examiner*—Carroll B. Dority, Jr.

*Attorney, Agent, or Firm*—Weingarten, Schurgin, Gagnebin & Hayes

[57] ABSTRACT

This invention relates a handy burner device comprising an ignition device as well as a combustion device, whereby fuel gas blown out of a nozzle can be automatically ignited by operation of the ignition device, and a valve device capable of suitably controlling a flow rate of liquefied gas fuel, whereby adjustment of combustion flame can be suitably effected according to the object of use, an intake quantity of air necessary for combustion can also be adjusted and in addition, thermal power of the burner can be controlled.

7 Claims, 5 Drawing Figures

BURNER DEVICE

This is a division of application Ser. No. 751,373, filed on July 2, 1985, now U.S. Pat. No. 4,597,732.

BACKGROUND OF THE INVENTION

1. Field of the Invention

This invention relates to a handy burner device for use of metalworks, the manufacture of artificial teeth, hobbies and the like.

2. Prior Art

In conventional burner devices of this kind, a combustion device is connected to a body which also serves as a fuel tank, a valve member provided on the combustion device is operated to blow out liquefied gas fuel from a nozzle of the combustion device, and the blown out gas is ignited by a cigarette lighter or a match.

Therefore, ignition has to be effected by a lighter or the like every time the burner is used, resulting in an inconvenience, and there poses a problem in that the burner cannot be used without an igniter.

SUMMARY OF THE INVENTION

This invention has been contemplated in order to solve these problems encountered in prior art. It is an object of the present invention to provide a handy burner device in which a combustion device also serves as an ignition device, and fuel gas blown out of a nozzle by operation of the ignition device can be automatically ignited.

It is a further object of the present invention to provide a handy burner device comprising a valve device which can suitably control a quantity of liquefied gas fuel, whereby a combustion frame can be suitably adjusted according to the object of use, an intake quantity of air necessary for combustion can be also adjusted, and even heating powder can be adjusted.

To achieve the above-described objects, the present invention comprises a fuel tank and body capable of being gripped, a valve device, a combustion device and an ignition device, which are connected to the upper portion of the body. The aforesaid body is interiorly provided with a member for supplying liquiefied gas fuel in its gaseous state to the valve device, which is provided with a member for controlling a flow rate of fuel and a needle valve for opening and closing a passage, and a flow rate of gas flowing into the combustion device can be adequately adjusted by an opening and closing degree of the needle valve and by the aforesaid control member.

The combustion device is provided with a main passage and a sub-passage located at the extreme end of a nozzle tube having an air intake hole, said air intake hole capable of being adjusted by an air adjusting cylinder rotatably and retractably provided in the periphery of the nozzle tube, said air adjusting cylinder being associated with an operating plate of the ignition device so that said cylinder can be operatively connected to the ignition device to open the air intake hole.

The aforesaid ignition device is composed of a piezo electronic unit, which is designed so that the piezo electronic unit is shocked and operated by a movable member which moves along with the aforesaid operating plate to generate a discharge spark between a discharge electrode provided on the extreme end of the nozzle tube and a nozzle head to ignite gas emitted from the sub-passage, and said ignition is propagated to the main passage to generate a burning flame.

Various devices are provided as described above. According to the burner device of the present invention, the aforesaid ignition device can be merely operated in a state wherein fuel gas is supplied to the combustion device to securely effect the ignition and combustion of fuel gas without employing other special means. In addition, such combustion can be continued unless a supply of fuel gas is stopped even if the ignition device is returned to its original mode.

The present invention will now be described in detail by way of embodiments shown in the accompanying drawings.

DETAILED DESCRIPTION OF THE INVENTION

Figure 1:
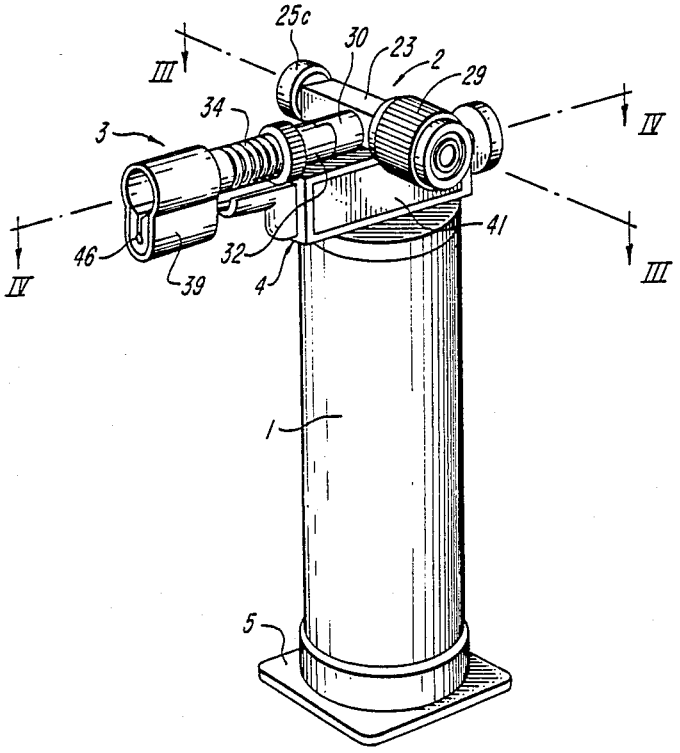
FIG. 1 is a perspective view of a burner device in accordance with the present invention.
Figure 2:
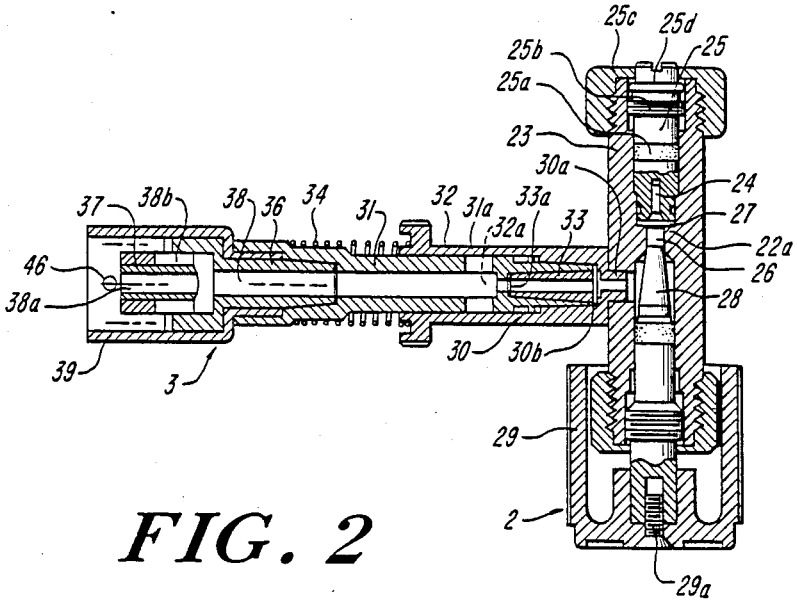
FIG. 2 is a cross sectional plan view showing an upper portion of the burner device.
Figure 5:
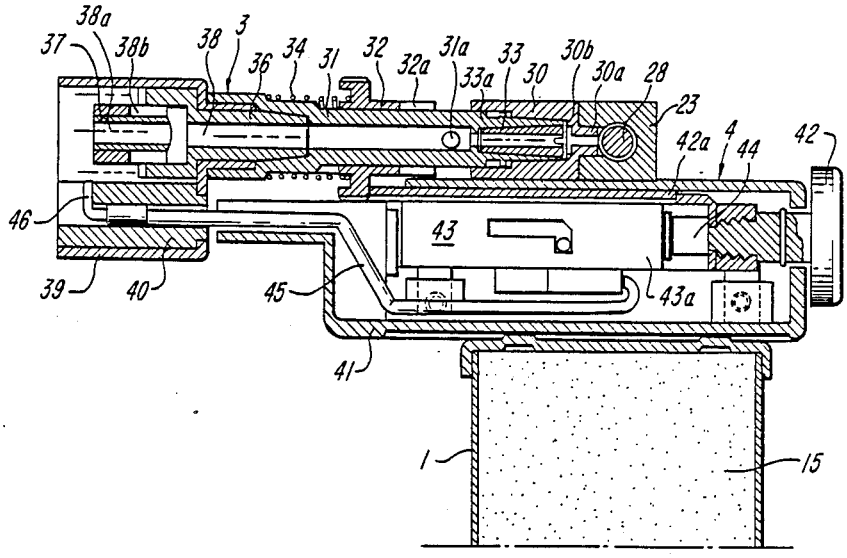
FIG. 5 is likewise a longitudinal sectional side view similar to FIG. 1 when ignition operation is effected.
Figure 3:
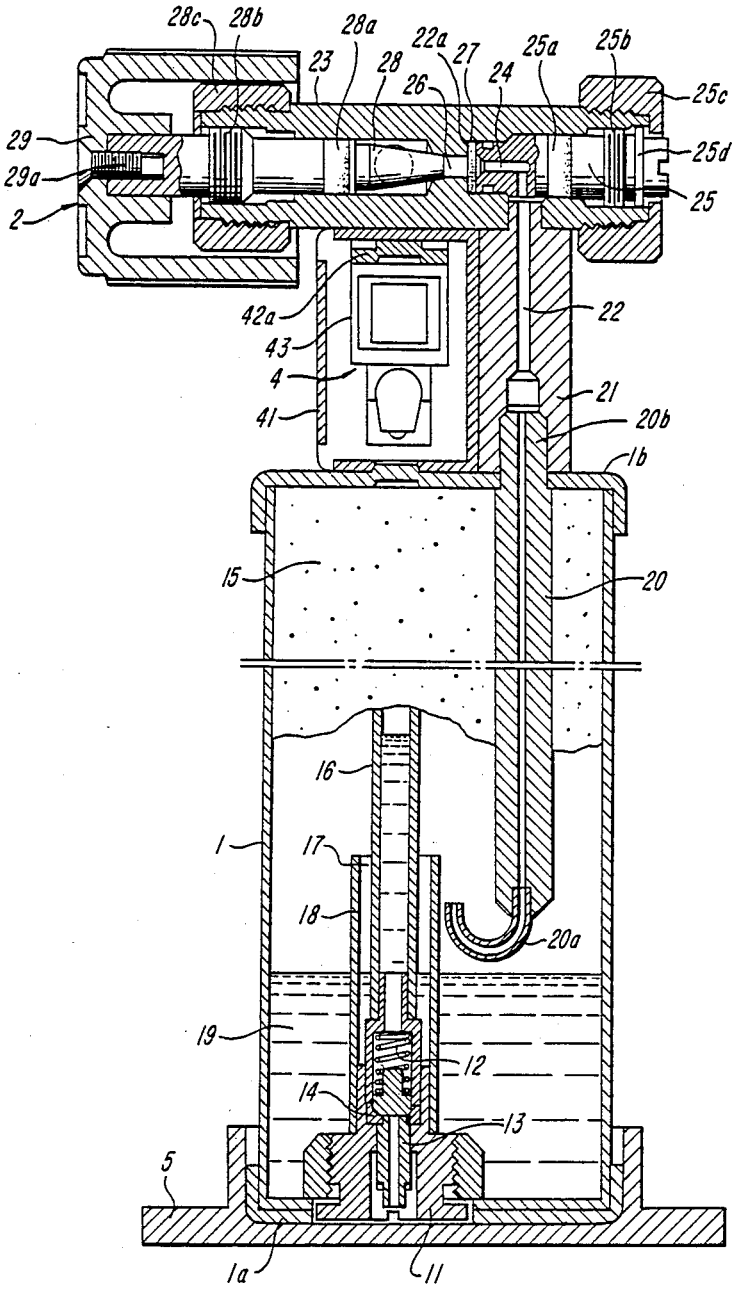
FIG. 3 is a longitudinal front view taken on line III—III of FIG. 1.
Figure 4:
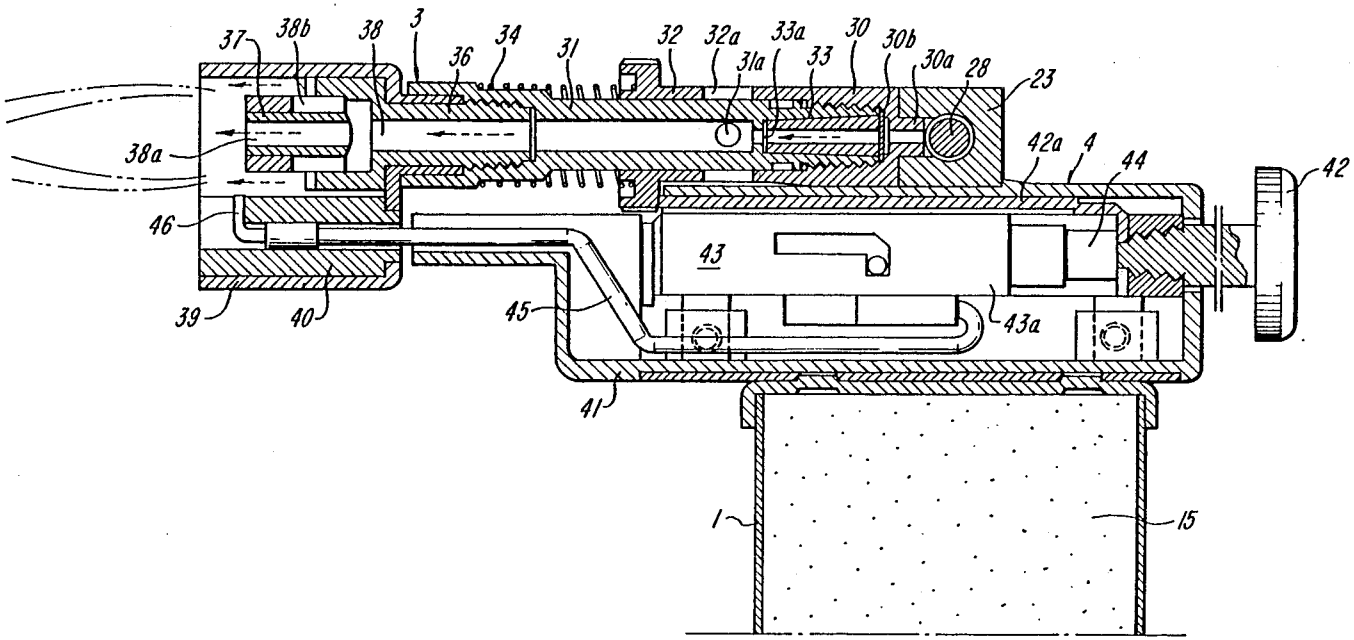
FIG. 4 is a longitudinal sectional side view taken on line IV—IV of FIG. 1.

A burner device, which is the size capable being gripped, comprises a cylindrical body 1 which also serves as a fuel tank, and devices including a valve device 2, a combustion device 3 and an ignition device 4 which are connected to an upper portion of the body 1. Reference numeral 5 designates a tray-like plate rotatably fitted in the bottom of the body.

The body 1 is provided at its bottom plate 1*a* with a filling valve 11. This filling valve 11 comprises a filling rod 13 normally biased in a valve closing direction by means of a spring 12 and a valve body 14, and further comprises a fuel conduit 16 in the form of a long shaft, supporting impregnant 15 filled in the upper portion within the body 1, and an exhaust pipe 18 arranged in the periphery of the conduit 16 leaving a predetermined clearance 17, so that when the body 1 is inverted to fill with liquefied gas fuel 19 and a liquid level reaches an open end of the exhaust pipe 18 to make it impossible to discharge gas within the body, further fuel cannot be filled.

A fuel supply pipe indicated at 20 has an upper end 20*b* provided within the body extending through an upper plate 1*b* of the body 1, and has a U-shaped pipe 20*a* provided at the lower end to be directed upwardly so as to prevent fuel dropping along the side of the fuel supply pipe 20 from flowing into the supply pipe in the form of liquid.

Connected to the upper end 20*b* projected from the upper plate 1*b* onto the body is a connecting member 21 between the body 1 and the valve device 2, and fuel within the body is supplied to the valve device 2 through a passage 22 interiorly of the connecting member 21.

The valve device 2 is provided on the upper portion of the body with a fixing member 23 mounted at a right angle, on a casing 41 of the ignition device 4 secured to the upper plate 1*b* of the body 1 along with the connecting member 21.

The fixing member 23 is formed at both ends with threads, and a flow control member 25 having at its extreme end a passage 24 in communication with the aforesaid passage 22 is inserted into the fixing member so that the member 25 may be rotated up to a valve seat 22*a* bored in a passage 26. This flow control member 25 comprises an O-ring 25*a* to impede fuel from flowing out in thereabout, threads 25*b* meshed with threads on the open inner side of the fixing member 23, and a flange 25*d* in contact with a nut-like stopper 25*c* threadedly mounted on the end of the fixing member 23.

A porous and resilient fuel control member 27 is interposed between the flow control member 25 and the valve seat 22*a*, and the fuel control member 27 can be compressed by rotation of the flow control member 27 to control the flow rate of gaseous fuel from the body 1.

A needle valve 28 for opening and closing the passage 26 is rotatably inserted into the fixing member 23, and a handle 29 is mounted on the outer end of the needle valve by means of a screw 29*a*. The needle valve 28 is peripherally formed with an O-ring 28*a* and threads 28*b* similar to the flow control member 25, and a nut-like stopper 28*c* in contact with the threads 28*b* is screwed into the end of the fixing member 23.

A nozzle pipe supporting member 30 of the combustion device 3 is connected in the form of a T-letter to the center on the side of the fixing member 23, that is, to a portion wherein the upper surface of a casing 41 of the ignititon device 4 is positioned. This supporting member 30 comprises a cylindrical body, in which a projected portion 30*a* in the center at the rear end bored with a passage is inserted into and integrally mounted in a hole on the side of the fixing member 23 so that the projected portion 30*a* may face to the extreme end of the needle valve 28.

The supporting member 30 is also secured to the casing 41. A rear end of the nozzle pipe 31 is screwed into the supporting member 30 from an opening at the end thereof to an internal side of the projected portion 30*a* into which a filter 30*b* is inserted. An air control cylinder 32 integrally formed with a handle is rotatably and axially movably fitted in the periphery of the nozzle pipe 31. The air control cylinder 32 is formed with a cut-in portion 32*a* for opening and closing an air intake hole 31*a* bored in the side of the nozzle pipe 31, and the air control cylinder 32 is biased against the extreme end of the supporting member 30 by means of a coiled spring 34 interposed over and between a shoulder formed frontwardly on the side of the nozzle pipe 31 and the extreme end of the air control cylinder 32.

Within the rear end of the nozzle pipe 31, an orifice having a diameter of 0.1 mm in a perforated plate 33*a* fixed by a threaded pipe 33 is provided closely to the air intake hole 31*a*. A nozzle tipe 36 along with a tip cover 39 is mounted on the extreme end of the nozzle pipe 31. A nozzle head 37 forming a nozzle orifice is fitted into the extreme end of the nozzle tip 36. A spline groove is formed in the periphery at the rear of the nozzle head 37, and a rear portion thereof is fitted into a receptacle at the tip end to form the head and tip together and a part of a pasage 38 is branched in the periphery of the head to form a main passage 38*a* and a sub-passage 38*b*.

The tip cover 39 is interiorly provided with an electrode base 40 parallel with the nozzle head 37, and in this electrode base 40, formed of an insulating material, a discharge electrode 46 is secured toward the extreme end of the nozzle head 37.

The aforesaid ignition device 4 comprises a piezo electronic unit 43 having the same construction as that of a piezo electronic generator used for a gas lighter or the like. This piezo electronic unit has a piezo electronic element within a fixing member 43*a*, and a shock is applied to the piezo electronic element by a hammer operated by a movable member 44 to generate a high electric current.

The piezo electronic unit 43 is accommodated into the casing 41 with the movable member 44 directed outwardly and fixed by means of a screw or the like. A pusher 42 which extends through the side wall of the casing is mounted on the movable member 44, and a lead wire 45 is connected to the discharge electrode 46.

An operating plate 42*a*, which moves along with the movable member 44 along the upper wall of the casing 41, is mounted between the movable member 44 and the pusher 42, and the extreme end of the operating plate 42*a* is in contact with the handle of the air control cylinder 32.

The nozzle head 37 is electrically connected to the piezo electronic unit 43 through the casing 41, the nozzle pipe supporting member 30, the nozzle pipe 31 and the nozzle tip 36, and a discharge spark is generated between the discharge electrode 46 and the nozzle head 37.

With the above-described construction, in the burner device, when the handle 29 is turned to open the passage 26 being closed by the needle valve 28 and thereafter the pusher of the piezo electronic unit 43 is pressed inwardly by the finger-tip, a discharge spark is generated between the discharge electrode 46 and the nozzle head 37 by operation of the piezo electronic unit 43. The thus generated spark ignites gaseous fuel emitted from the sub-passage 38*b* and the aforesaid ignition propagates to fuel emitted from the main passage 38*a*.

As the movable member 44 moves, the operating plate 42*a* also moves whereby the air control cylinder 32 in contact with the extreme end thereof is moved forward against the coiled spring 34. This movement causes the air intake hole 31*a* of the nozzle pipe 31 to open even if it is blocked by the air control cylinder 32 to let air flow into the nozzle pipe 31. This entry of air causes to form a mixture of fuel and air, and the combustion resulting from discharge is turned into a violent flame of high temperature, 1,300° C.

After the ignition, the piezo electronic unit 43 is returned to a state prior to operation by releasing a pressing force against the pusher 42 but the combustion continues unless the passage 26 is closed by the needle valve 28. Since the operating plate 42*a* returns along with the movable member 44, the air control cylinder 32 is also pushed back by the coiled spring 34, and the air intake hole 31*a* is blocked according to the position of the cut-in 32*a*. In this case, however, the air control cylinder 32 may be turned to register the cut-in 32*a* with the air intake hole 31*a*. An intake quantity of air can be adjusted by such registration.

Moreover, fuel controlled in quantity by the control member 27 can be secondarily control according to the opening degree of the needle valve, and combustion temperature can be suitably controlled by adjustment of these parts noted above.

What is claimed is:

1. A burner device comprising a fuel tank and body having a size capable of being gripped by hand, and a valve device, a combustion device and an ignition device which are connected to an upper portion of said body; said valve device having a passage to which fuel is supplied from said body, said passage being provided with a valve means; said combustion device comprising a nozzle supporting member connected to the valve device and in communication with the passage, a nozzle pipe whose rear end is connected to said nozzle supporting member and bored with an air intake hole opened and closed by an air control cylinder biased by a coiled spring, connected to said nozzle pipe and said air control cylinder, over said air intake hole, and a nozzle head at the extreme end of said nozzle pipe; and said ignition device comprising a piezo electronic unit within a casing connected to the body, said ignition device being electrically connected to a discharge electrode provided at the end of the combustion device and being directed at said nozzle head.

2. A burner device comprising a fuel tank and body having a size capable of being gripped by hand, and a valve device, a combustion device and an ignition device which are connected to an upper portion of said body; said valve device having a passage to which fuel is supplied from said body, said passage being provided with a control member acted upon by a threadably mounted flow control member and a needle valve in said passage downstream of said control member; said combustion device comprising a nozzle supporting member connected to the side of the valve device and in communication with the passage, a nozzle pipe whose rear end is connected to said nozzle supporting member and bored with an air intake hole opened and closed by an air control cylinder biased by a coiled spring, connected to said nozzle pipe and said air control cylinder, over said air intake hole, a nozzle tip mounted in a forward end of said nozzle pipe, and a nozzle head fitted into said nozzle tip to form a passage extending through said nozzle tip and nozzle head into a main passage and a sub-passage; and said ignition device comprising a piezo electronic unit within a casing connected to the body, and an operating member which is moved along with a movable member of said piezo electronic unit to move forward said air control cylinder, said ignition device being electrically connected to a discharge electrode provided at the end of the combustion device and being directed at said nozzle head.

3. The burner device according to claim 2, wherein said body is interiorly provided with a fuel filling valve, and a fuel supply pipe whose upper end extends through an upper plate of the body and having an upwardly-directed U-shaped pipe mounted on a lower end thereof.

4. The burner device according to claim 3, wherein said valve device is secured to the body through a connecting member at the upper end of said fuel supply pipe and positioned at a right angle to said connecting member on a casing of the ignition device on the body.

5. The burner device according to claim 2, wherein said movable member of said piezo electronic unit has a pusher positioned externally of the casing.

6. The burner device according to claim 2, including a tip cover, and said nozzle head having a spline groove in the periphery at the rear thereof and is fitted into said nozzle tip to form said main passage and said sub-passage.

7. The burner device according to claim 6, wherein an electrode base is provided within said tip cover, and said discharge electrode is provided on said electrode base.

* * * * *